US007304465B2

(12) United States Patent
Inagaki et al.

(10) Patent No.: US 7,304,465 B2
(45) Date of Patent: Dec. 4, 2007

(54) POWER SUPPLY CIRCUIT CAPABLE OF EFFICIENTLY SUPPLYING A SUPPLY VOLTAGE

(75) Inventors: Yasuhiko Inagaki, Atsugi (JP); Takayuki Masaki, Atsugi (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/615,232

(22) Filed: Jul. 8, 2003

(65) Prior Publication Data

US 2004/0056645 A1 Mar. 25, 2004

(30) Foreign Application Priority Data

Sep. 24, 2002 (JP) ..... 2002-277758

(51) Int. Cl.
*G05F 3/16* (2006.01)
*G05F 3/20* (2006.01)

(52) U.S. Cl. ..... 323/313; 323/315; 323/314

(58) Field of Classification Search ..... 323/313, 323/314, 315, 312
See application file for complete search history.

(56) References Cited

U.S. PATENT DOCUMENTS 4,330,723 A * 5/1982 Griffith ..... 326/19
4,860,154 A * 8/1989 Fazlollahi ..... 361/101
5,103,148 A * 4/1992 Berringer et al. ..... 318/432
5,424,665 A * 6/1995 Sueri et al. ..... 327/108
5,754,066 A * 5/1998 Smith ..... 327/108
5,764,042 A * 6/1998 Beier et al. ..... 323/316
5,883,501 A * 3/1999 Arakawa ..... 323/315
5,920,185 A * 7/1999 Ozoe ..... 323/315
6,242,898 B1 * 6/2001 Shimizu et al. ..... 323/313
6,329,871 B2 * 12/2001 Taguchi ..... 323/315
6,549,156 B1 * 4/2003 Moser ..... 341/144
6,657,481 B2 * 12/2003 Rasmussen et al. ..... 323/315
6,677,799 B1 * 1/2004 Brewer ..... 327/344
6,791,397 B2 * 9/2004 Shimozono ..... 327/543
6,815,939 B2 * 11/2004 Umemoto et al. ..... 323/286

FOREIGN PATENT DOCUMENTS

JP 57-89332 11/2000
JP 2002-135071 5/2002

* cited by examiner

*Primary Examiner*—Bao Q. Vu
(74) *Attorney, Agent, or Firm*—Ladas and Parry LLP

(57) ABSTRACT

A power supply circuit generates a supply voltage based on an input constant voltage and supplies the supply voltage to a load. A delay circuit delays the input constant voltage. An output circuit generates the supply voltage from the input constant voltage delayed by the delay circuit and supplies the supply voltage to the load. A current generation circuit generates a current based on the supply voltage that is generated by the output circuit and supplies the generated current to the output circuit as a drive current.

7 Claims, 5 Drawing Sheets

POWER SUPPLY CIRCUIT CAPABLE OF EFFICIENTLY SUPPLYING A SUPPLY VOLTAGE

BACKGROUND OF THE INVENTION

1. Field of the Invention

The present invention generally relates to power supply circuits, and more particularly, to a power supply circuit that delays and outputs an output voltage with respect to an input voltage.

2. Description of the Related Art

Power supply circuits supplying drive power for driving, for example, amplifiers are provided with a delay circuit that delays the rise of the drive power for an amplifier so as to improve ripple rejection characteristics and prevent generation of shock noise at the rise of the power.

FIG. 1 is a circuit configuration diagram of an example of conventional power supply circuits.

Here, a description will be given by taking an amplifier circuit 1 as an example. The amplifier circuit 1 is constructed by a power supply circuit 11 and an amplifier 12. The power supply circuit 11 is a circuit that generates a drive voltage for supplying the drive voltage to the amplifier 12 based on a supply voltage Vcc that is supplied from a power terminal Tv. The amplifier 12 amplifies and outputs, from an output terminal Tout, an input signal that is input to an input terminal Tin based on the drive voltage supplied from the power supply circuit 11.

The power supply circuit 11 is constructed by a reference voltage generation circuit 21, a delay circuit 22, and an output circuit 23. The reference voltage generation circuit 21 is constructed by a constant-current source 31 and a Zener diode Dz. The constant-current source 31 generates a constant current I1 from the supply voltage Vcc applied to the power terminal Tv. The constant-current I1 is supplied to the Zener diode Dz.

The Zener diode Dz generates a Zener voltage Vz based on the constant current I1. The Zener voltage Vz is applied to the delay circuit 22. The delay circuit 22 is constructed by a resistance R1 and a capacitor C1. The delay circuit 22 has a time constant τ that is determined by the resistance R1 and the capacitor C1. The delay circuit 22 delays the Zener voltage Vz that is output from the reference voltage generation circuit 21 only for the time constant τ, and then supplies the Zener voltage to the output circuit 23. The capacitor C1 is an external component. One end of the capacitor C1 is connected to a terminal Tc and the other end is grounded.

The output circuit 23 is constructed by a NPN transistor Q1. In the transistor Q1, the delayed output of the delay circuit 22 is supplied to the base, the supply voltage Vcc is supplied to the collector from the power terminal Tv, and the drive voltage for the amplifier 12 is output from the emitter.

FIG. 2 is an illustrative drawing for explaining the operation of the conventional power supply circuit. FIG. 2-A indicates the supply voltage Vcc, and FIG. 2-B indicates the base potential and emitter potential of the transistor Q1.

When the supply voltage Vcc rises at time t0, the base potential VB and emitter potential VE of the transistor Q1 rise after being delayed by the delay circuit 22. On this occasion, the base potential VB of the transistor Q1 can be expressed by:

$$VB=Vz-(IB\times R1) \text{ . . . Equation} \quad (1)$$

where the output voltage of the reference voltage generation circuit 21 is Vz and the base current of the transistor Q1 is IB. The voltage (IB×R1) is the amount of voltage drop caused by the resistance, R1 of the delay circuit 22.

Further, the emitter potential VE of the transistor Q1 can be expressed by:

$$VE=Vz-(IB\times R1)-VF \text{ . . . Equation} \quad (2)$$

where VF represents the forward voltage between the base and emitter of the transistor Q1.

In the conventional power supply circuit, however, the resistance R1 of the delay circuit 22 causes voltage drop, and the supply voltage VE applied to the amplifier 12 assumes the voltage expressed by Equation (2)

On the other hand, regarding electronic circuits and electronic devices, there are demands for IC compatibility, cost reduction, miniaturization, and the like. In order to achieve IC compatibility, cost reduction, miniaturization, and the like, it is necessary to limit the capacitance of the capacitor C1 of the delay circuit 22. In order to obtain a delay time τ similar to that in the conventional power supply circuit while limiting the capacitance of the capacitor C1, it is necessary to increase the resistance R1.

When the resistance R1 is increased, the second term of Equation (2) is increased. Accordingly, the supply voltage VE is decreased. When the supply voltage VE is decreased, the amplifier circuit 1 shown in FIG. 1 encounters problems in that the peak magnitude of the amplifier 12 is decreased, for example.

SUMMARY OF THE INVENTION

It is a general object of the present invention to provide an improved and useful power supply circuit in which the above-mentioned problems are eliminated.

It is another and more specific object of the present invention to provide a power supply circuit capable of efficiently supplying a supply voltage while positively reducing noise shock, for example.

In order to achieve the above-mentioned objects, according to one aspect of the present invention, there is provided a power supply circuit for generating a supply voltage based on an input constant voltage and supplying the supply voltage to a load, the power supply circuit including:

- a delay circuit delaying the input constant voltage;
- an output circuit generating the supply voltage from the input constant voltage delayed by the delay circuit and supplying the supply voltage to the load; and
- a current generation circuit generating a current based on the supply voltage that is generated by the output circuit and supplying the generated current to the output circuit as a drive current.

Also, the current generated by the current generation circuit may be set to a current value to drive the output circuit.

In addition, the delay circuit may include:

- a resistance serially provided between an input terminal to which the input constant voltage is applied and the output circuit; and
- a capacitance element provided between a connection point of the resistance and the output circuit and a base potential terminal serving as a base potential (GND) and delaying the input constant voltage.

Accordingly, the current generation circuit generates the current in accordance with the supply voltage generated by the output circuit and supplies the generated current to the output circuit as the drive current. Thus, it is possible to supply the drive current to the output circuit without going through the delay circuit. Accordingly, it is possible to eliminate the influence of attenuation caused by the delay circuit.

Further, when the supply voltage is supplied to a plurality of loads, the delay circuit may be provided for the plurality of loads in common, and the output circuit and the current generation circuit may be provided for each of the plurality of loads.

Accordingly, by providing the plurality of loads with the respective output circuits and current generation circuits, it is possible to eliminate the influence of attenuation caused by the delay circuit with respect to the plurality of loads.

Other objects, features and advantages of the present invention will become more apparent from the following detailed description when read in conjunction,with the following drawings.

DETAILED DESCRIPTION OF THE PREFERRED EMBODIMENTS

Figure 1:
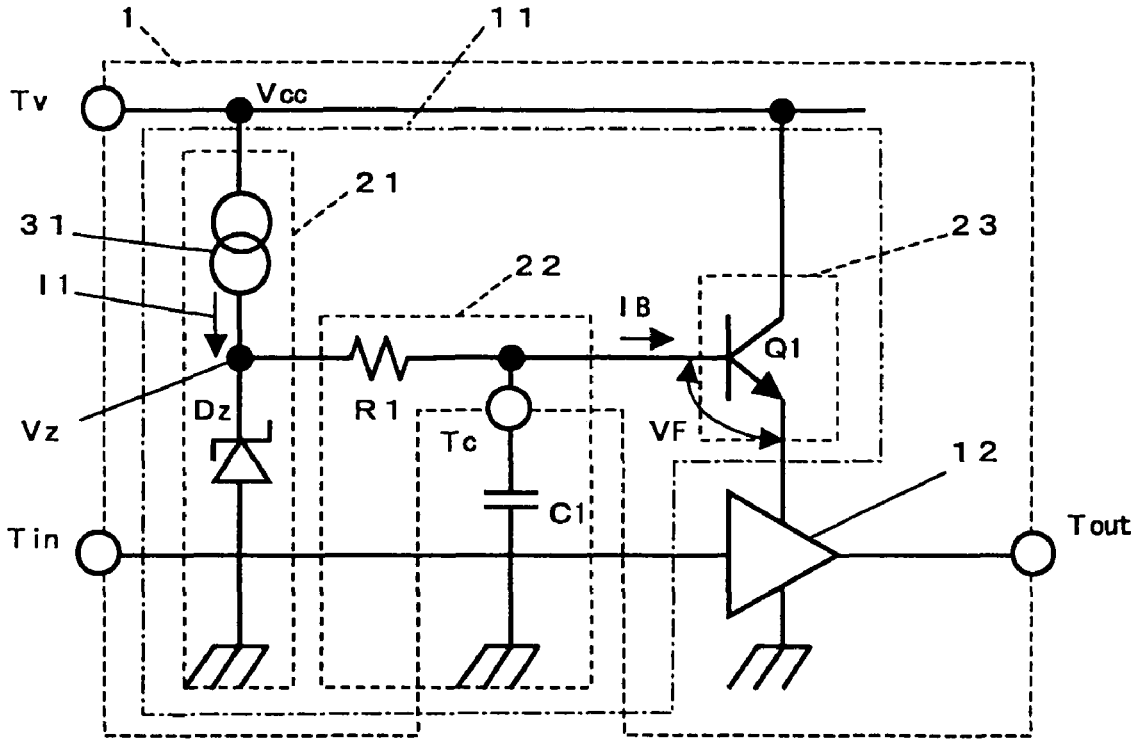
FIG.1 PRIOR ART
FIG. 1 is a circuit configuration diagram of a conventional power supply circuit.
Figure 2:
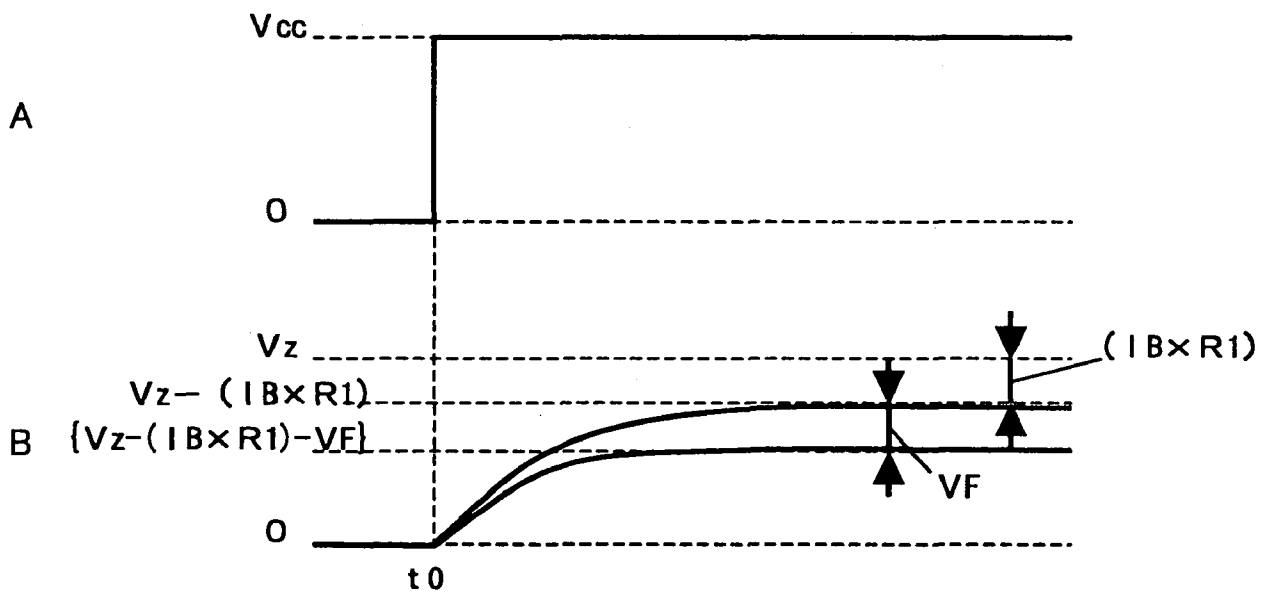
FIG.2 PRIOR ART
FIG. 2 is an illustrative drawing for explaining the operation of the conventional power supply circuit.
Figure 3:
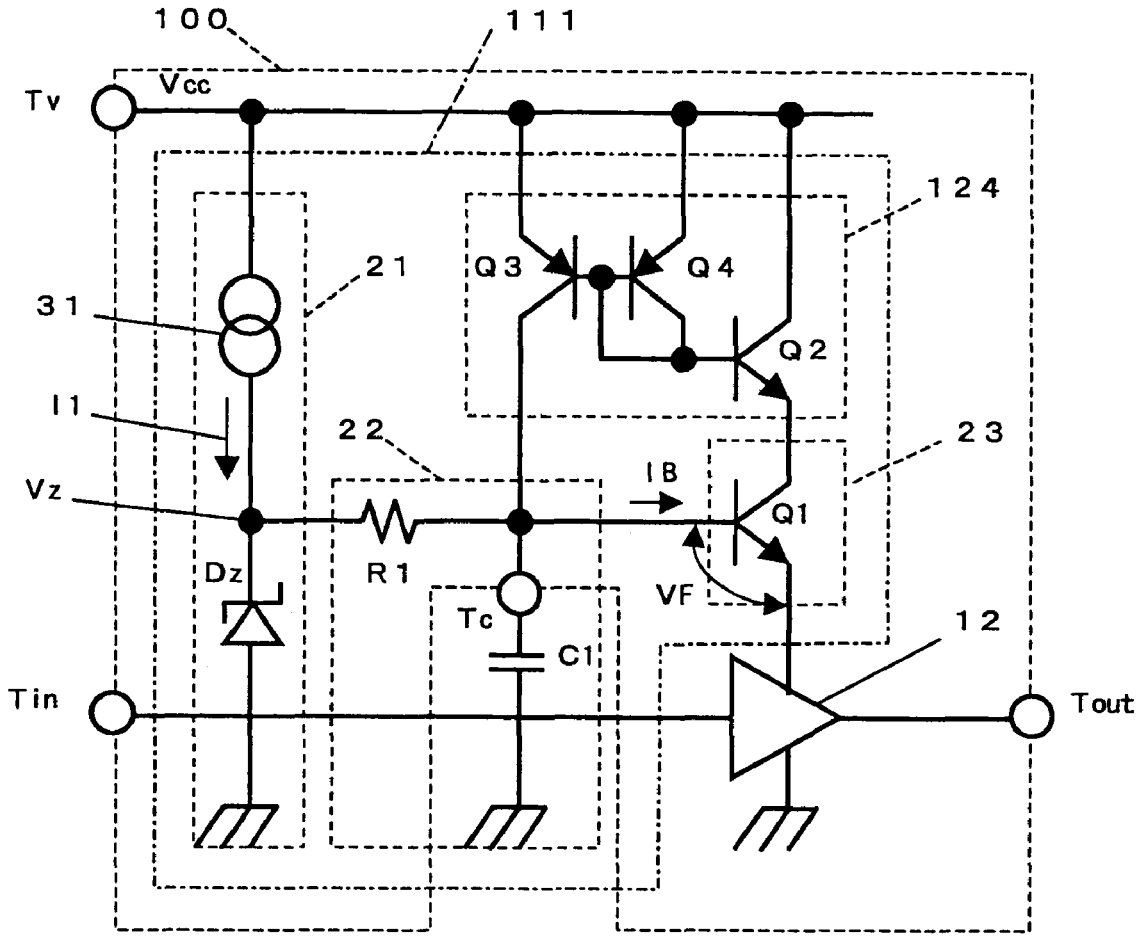
FIG. 3 is a circuit configuration diagram of one embodiment of the present invention.

FIG. 3 is a circuit configuration diagram of one embodiment of the present invention. In FIG. 3, those parts that are the same as those corresponding parts in FIG. 1 are designated by the same reference numerals, and a description thereof will be omitted.

FIG. 3 shows the circuit configuration of an amplifier IC 100 incorporating therein a power supply circuit 111 of this embodiment. The amplifier IC 100 is constructed by the power supply circuit 111 and the amplifier 12. The power supply circuit 111 of this embodiment includes a current generation circuit 124 in addition to the conventional power supply circuit 11 shown in FIG. 1.

The current generation circuit 124 is constructed by a NPN transistor Q2 and PNP transistors Q3 and Q4. The transistor Q2 is connected between the power terminal Tv and the output circuit 23 and driven when the transistor Q1, constructing the output circuit 23, is driven.

The transistors Q3 and Q4 construct a current mirror circuit, which outputs a current (hereinafter referred to as a "collector current") Ic3 corresponding to the base current of the transistor Q2 from the collector of the transistor Q3. The collector current Ic3 output from the collector of the transistor Q3 is supplied to the connection point of the delay circuit 22 and the base of the transistor Q1.

The collector current Ic3 of the transistor Q3 is set to a desired current IB that is to be supplied to the base of the transistor Q1. The collector current Ic3 of the transistor Q3 is set by, for example, the emitter areas of the transistors Q3 and Q4.

The current generation circuit 124 is driven in accordance with the operating state of the transistor Q1 that constructs the output circuit 23. On this occasion, the operation of the output circuit 23 is delayed by the delay circuit 22 at the rise of the supply voltage Vcc. Since the current generation circuit 124 is driven in accordance with the operation of the output circuit 23, the operation of the current generation circuit 124 is also delayed by the delay in the operation of the output circuit 23. Hence, shock noise is not generated by driving the current generation circuit 124.

Figure 4:
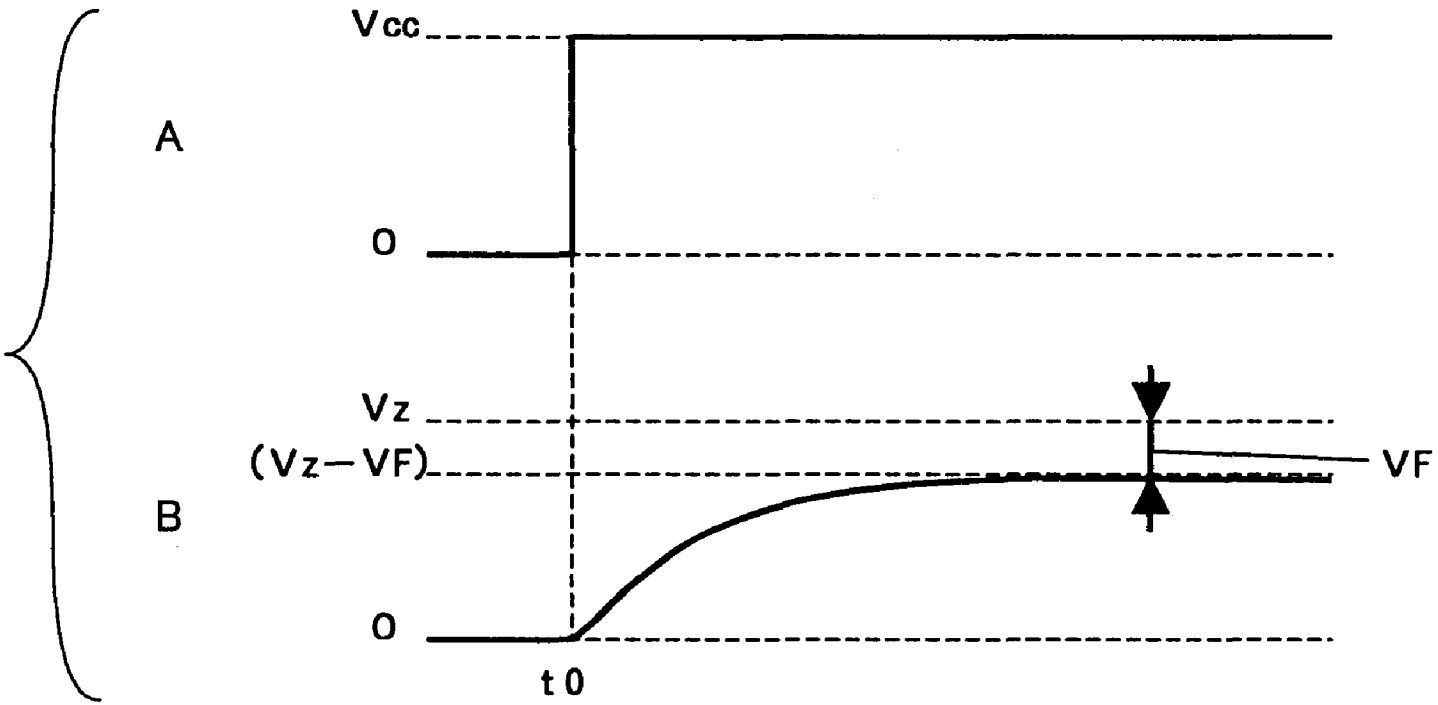
FIG. 4 is an illustrative drawing for explaining the operation of the embodiment of the present invention.

FIG. 4 is an illustrative drawing for explaining the operation of the embodiment of the present invention. FIG. 4-A indicates the supply voltage Vcc, and FIG. 4-B indicates the emitter potential of the transistor Q1.

When the supply voltage Vcc rises at time t0, the emitter potential of the transistor Q1 rises after being delayed by the time constant $\tau$ that is determined by the resistance R1 and capacitor C1 of the delay circuit 22.

On this occasion, the base current IB of the transistor Q1 is supplied from the current generation circuit 124, and a current does not flow to the resistance R1. Consequently, the second term (IB×R1) of Equation (2) becomes "0". Thus, the emitter potential VE of the transistor Q1 can be expressed by:

$$VE=Vz-VF \ldots \text{Equation} \quad (3)$$

where VF is the forward voltage between the base and emitter of the transistor Q1.

In other words, it is possible to increase the voltage that can be applied to the amplifier 12 only for (IB×R1), compared to the conventional technique. Accordingly, it is possible to increase the peak magnitude of the amplifier 12 only for the amount corresponding to (IB×R1).

In addition, the present invention may be applied also to an IC incorporating therein a plurality of the amplifiers 12.

Figure 5:
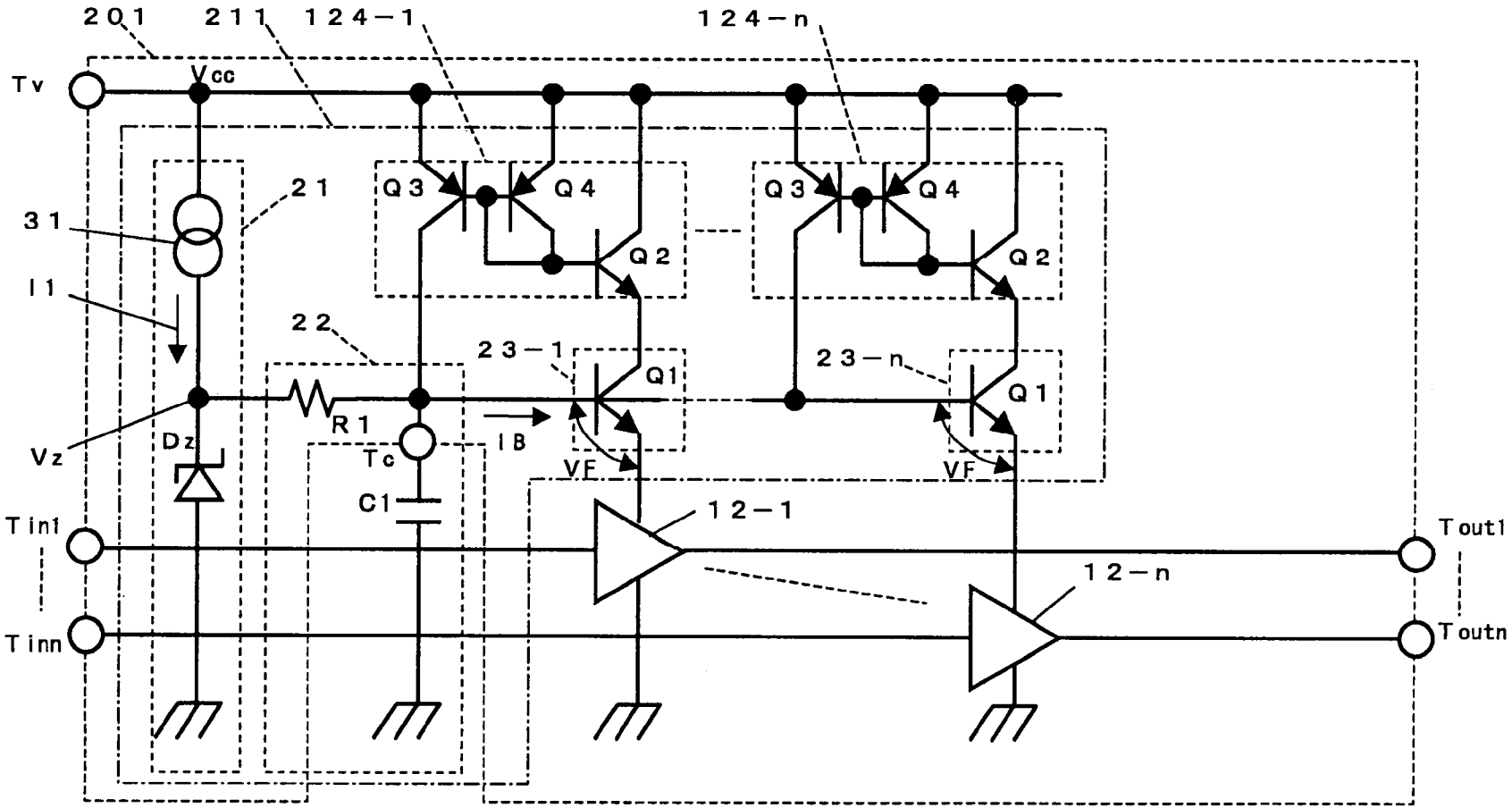
FIG. 5 is a circuit configuration diagram of another embodiment of the present invention.

FIG. 5 is a circuit configuration diagram of another embodiment of the present invention. In FIG. 5, those parts that are the same as those corresponding parts in FIG. 3 are designated by the same reference numerals, and a description thereof will be omitted.

An amplifier circuit 201 of this embodiment includes therein a plurality of amplifiers 12-1 through 12-n. The plurality of amplifiers 12-1 through 12-n are provided with respective output circuits 23-1 through 23-n and current generation circuits 124-1 through 124-n.

The current generation circuit 124-1 supplies the base current IB to the output circuit 23-1. The current generation circuit 124-2 supplies the base current IB to the output circuit 23-2. Similarly, the current generation circuit 124-n supplies the base current IB to the output circuit 23-n.

The present invention is not limited to the specifically disclosed embodiments, and variations and modifications may be made without departing from the scope of the present invention.

The present application is based on Japanese priority application No. 2002-277758 filed on Sep. 24, 2002, the entire contents of which are hereby incorporated by reference.

What is claimed is:

1. In a power supply circuit for generating a supply voltage based on an input constant voltage and supplying the supply voltage to a load, the improvements comprising:

a delay circuit configured to delay the input constant voltage;

an output circuit configured to generate the supply voltage from the input constant voltage delayed by the delay circuit and to supply the generated supply voltage to the load; and a current generation circuit generating a current based on the supply voltage that is generated by said output circuit and supplying the generated current to said output circuit as a drive current, wherein said current generation circuit includes:

a first transistor whose collector and emitter are connected in serial to a current path to the output circuit, a second transistor whose collector and emitter are located between a base of the first transistor and the input constant voltage; and a third transistor whose collector is connected to a connection point between the output circuit and the delay circuit, said third transistor forming a current mirror together with the second transistor, whereby said drive current is supplied to the connection point between the output circuit and the delay circuit from the collector of the third transistor.

2. The power supply circuit claimed in claim 1, wherein a current supplied to an input of the output circuit from the current generation circuit is set to a current value to drive the output circuit.

3. The power supply circuit claimed in claim 1, wherein the current generation circuit includes a circuit component which has the same electrical characteristic as the output circuit, is connected to the output in series, and supplies a current to an input of the output circuit, said current having the same magnitude as a drive current for the circuit component.

4. The power supply circuit claimed in claim 1, wherein the delay circuit comprises:

a resistance serially provided between an input terminal to which the input constant voltage is applied and the output circuit; and a capacitance element provided between a connection point of said resistance and the output circuit and a base potential terminal serving as a base potential and delaying the input constant voltage.

5. The power supply circuit claimed in claim 1, wherein, when the supply voltage is supplied to a plurality of loads, the delay circuit and the output circuit and the current generation circuit are provided for each of the loads.

6. The power supply circuit claimed in claim 1, wherein electrical characteristics of the transistors are the same.

7. The power supply circuit claimed in claim 6, wherein the current generation circuit is connected directly to the output circuit.

* * * * *